United States Patent [19]

Durchschlag et al.

[11] Patent Number: 4,860,978

[45] Date of Patent: Aug. 29, 1989

[54] CONTROL MECHANISM FOR RAILWAY SWITCHES

[75] Inventors: Gerald Durchschlag, Zeltweg; Alfred Lang, Wiesen, both of Austria

[73] Assignee: Voest-Alpine Aktiengesellschaft, Linz, Austria

[21] Appl. No.: 204,355

[22] Filed: Jun. 9, 1988

[30] Foreign Application Priority Data

Jun. 9, 1987 [AT] Austria ..... 1456/87

[51] Int. Cl.[4] ..... E01B 7/02

[52] U.S. Cl. ..... 246/448

[58] Field of Search ..... 246/415 R, 448, 449, 246/450, 451, 452

[56] References Cited

U.S. PATENT DOCUMENTS

| | | | |
|---|---|---|---|
| 394,943 | 12/1888 | Strom | 246/449 |
| 951,107 | 3/1910 | Einstein | 246/451 |
| 962,698 | 6/1910 | Conley | 246/451 |
| 2,177,148 | 10/1939 | Newhall | 246/450 R |
| 3,977,635 | 8/1976 | Pirker et al. | 246/415 R |

FOREIGN PATENT DOCUMENTS

| | | | |
|---|---|---|---|
| 213941 | 3/1961 | Austria | 246/452 |
| 250433 | 9/1964 | Austria . | |
| 382128 | 3/1982 | Austria . | |
| 542402 | 1/1932 | Fed. Rep. of Germany | 246/448 |
| 837397 | 7/1949 | Fed. Rep. of Germany | 246/448 |
| 2245719 | 11/1979 | Fed. Rep. of Germany | 246/415 R |
| 1223768 | 6/1960 | France | 246/452 |
| 196526 | 7/1938 | Switzerland | 246/452 |

*Primary Examiner*—Robert B. Reeves
*Assistant Examiner*—Gary C. Hoge
*Attorney, Agent, or Firm*—Cushman, Darby & Cushman

[57] ABSTRACT

A rail switch control mechanism including a locking clamp which is shiftable using a path rod. The locking clamp has, on an end facing the switch tonque, a swivel head. The swivel head is swivelably connected with a switch tongue. In use, the locking clamp cooperates with a locking piece. In the locked position of the clamp, a shoulder of the locking clamp contacts a shoulder of the locking piece. The switch tongue rail is linked to the swivel head with the interposition of a pin arranged with an elongated slot extending longitudinally of the tongue rail. The elongated slot is arranged within a connecting member which is rigidly connected to the switch tongue rail, e.g. by being threadedly connected, to the web of the switch tongue rail.

7 Claims, 4 Drawing Sheets

CONTROL MECHANISM FOR RAILWAY SWITCHES

BACKGROUND OF THE INVENTION

1. Field of the Invention

This invention refers to a switch control mechanism comprising a locking clamp being shiftable by means of a push rod and having on its end facing the switch tongue or the like a swivel head being swivelably connected with the switch tongue and comprising at its other end a locking clamp head cooperating with a locking piece, noting that a shoulder of the locking clamp head contacts in the locked position a shoulder of the locking piece and noting that the switch tongue rail is linked to the swivel head of the locking clamp with interposition of a pin arranged within an elongated slot extending in the longitudinal direction of the tongue rail. It is in particular on occasion of extreme temperature conditions that a longitudinal extension of the switch tongue takes place, which may give rise to jamming of the push rod and of the locking clamp within the locking piece if the switch tongue is rigidly linked to the swivel head. On account of the pin, with interposition of which the switch tongue is linked to the swivel head, engaging an elongated slot of the switch tongue extending in the longitudinal direction of the switch tongue, such longitudinal expansions of the switch tongue are compensated and neutralized.

2. Description of the Prior Art

Such an arrangement has become known from AT-PS No. 250 433. In this case, the pin is engaging an elongated slot provided in the rail foot of the tongue rail. The disadvantage of this arrangement is that the tongue rail is weakened by this elongated slot and there exists the risk of fracture. From AT-PS No. 382 128 there has become known an arrangement in which the locking piece is connected with the stock rail for being shiftable in longitudinal direction of the rail and thus for accommodating a longitudinal expansion of the tongue rail. In this arrangement, the swivel head of the locking clamp is rigidly linked to the tongue rail, so that weakening of the tongue rail on account of elongated slots provided in the rail foot is avoided. The bearing means of the pin for linking the swivel head is connected with the locking piece via a rod structure, and in case of a longitudinal expansion of the switch tongue, the locking piece is thus shifted along the stock rail, so that the relative position of the locking piece with respect to the swivel point of the tongue rail on the swivel head remains unchanged. In this case, there must be provided sliding surfaces for the locking piece and in case of lacking permanent servicing of these sliding surfaces friction of these sliding surfaces is possible and jamming may again occur. Such an arrangement is relatively complicated and expensive and also offers no complete safety against jamming, because the locking piece must be taken along on occasion of longitudinal expansions of the tongue rail and jamming may already occur if taking along is effected by the rod structure. In the embodiment, in which linking of the tongue rail to the swivel head of the locking clamp is effected via an elongated slot, longitudinal expansions of the tongue rail are, however, directly compensated at the location of its origin.

SUMMARY OF THE INVENTION

It is the object of the invention to simplify the construction in an arrangement described above, to eliminate any risk of fracture of the tongue rail and to provide the possibility for a more precise linking and guiding of the locking clamp. For solving this task, the invention essentially consists in that the elongated slot is provided in a connecting member being rigidly connected with, in particular being screwed to the switch tongue rail or the like. On account of the elongated slot being provided in a connecting member, weakening of the rail foot of the switch tongue rail or the like is avoided. If this connecting member is screwed to the switch tongue rail, the threaded holes do not represent a dangerous weakening. On account of the fact that any weakening of the rail by an elongated slot is avoided, this switch control mechanism can be used as the first locking means for the rail tongue as well as the second or third locking means, for example for the wing rails. Such a connecting member can more precisely be machined than the rail foot and linking of the connecting member to the swivel head can thus be effected in a more precise manner. Conveniently, the connecting member comprises a plate having parallel faces and having arranged therein the elongated slot, noting that the swivel head preferably embraces the plate at both sides. Such a plate having parallel faces can precisely be machined to such extent that a high degree of movability is made sure with an only small play between the engaging surfaces of swivel head and plate.

In this case, the arrangement is conveniently selected such that the plate having parallel faces and comprising the elongated slot is located approximately in the plane of the foot of the tongue rail. The arrangement is preferably such that the swivel head has a bracket embracing the push rod within the area of the linking point to the connecting member. Provision of such a bracket is facilitated on account of the elongated slot being arranged within a connecting member which laterally protrudes from the foot of the tongue rail and thus provides sufficient space for the bracket. The locking clamp is thus shiftably connected with the push rod in a simple manner. Conveniently, the bracket is formed of a bar bent to the shape of a hook and being welded to the swivel head. According to a preferred embodiment, the swivel head has a bracket at both sides. This provides the advantage that one and the same locking clamp may be used at the left-hand side and the right-hand side.

According to the invention, the pin, by means of which the tongue rail is linked to the swivel head, may be supported in off-center position within a sliding block of preferably square shape and being guided within the elongated slot. By rotating the sliding block, the distance between the linking pin of the swivel head and the tongue rail may be adjusted. If this sliding block is, as seen in a top plan view, of square shape, there result four adjusting positions and adjusting operation can thus be effected in smaller steps. On account of the elongated slot being arranged within a separated connecting member, which can more precisely be machined than the rail foot itself, such steps of fine-adjustment by means of the square sliding block can effectively be utilized. If the elongated slot is provided within a component part having not been precisely machined, for example within the rail foot, such precision of adjustment is not achieved.

According to a preferred embodiment of the invention, the connecting member is screwedly connected to the web of the tongue rail. This has the advantage that the threaded holes provided in the web of the tongue rail scarcely cause weakening of the tongue rail and there exists the additional advantage that adjusting of the distance of the linking pin of the swivel head may be effected by simply positioning spacer plates between the web of the tongue rail and the connecting member. In this case, the arrangement is, according to the invention, conveniently selected such that the connecting member is formed of two plate members extending one relative to the other at an approximately right angle and being welded at their ends to lateral cheeks, noting that one plate member has the elongated slot between the lateral cheeks and the other plate member has holes for screws connecting the connecting member with the web of the tongue rail. In this manner, there is provided a stable and rigid connecting member and provided for precisely guiding the linking pin of the swivel head within the elongated slot.

However, the connecting member may, according to the invention, also be connected with the foot of the tongue rail, noting that the connecting member overlaps the foot and approximately extends within the plane of the foot.

The locking piece may screwedly be fixed to the outside of the web of the stock rail. In this manner, the locking piece is rigidly fixed in its position, noting that the pin of the swivel head is allowed to freely move within the elongated slot and may always remain in the same relative position with respect to the locking piece. In this case, the arrangement is, according to the invention, conveniently selected such that the locking piece is located beneath the rail foot of the stock rail and forms an integral component part with a flange screwedly connected to the web of the stock rail, said component part embracing the foot of the stock rail.

The inventive switch control mechanism can be used for switch tongues or tongue rails. This is because it is also important for the tongue rail that the rail foot be not weakened by an elongated slot. Likewise, the inventive switch control mechanism may also be used for movable frog tips.

BRIEF DESCRIPTION OF THE DRAWING

In the drawing, the invention is schematically explained with reference to examples of embodiment.

DETAILED DESCRIPTION OF THE PREFERRED EMBODIMENTS

Figure 1:
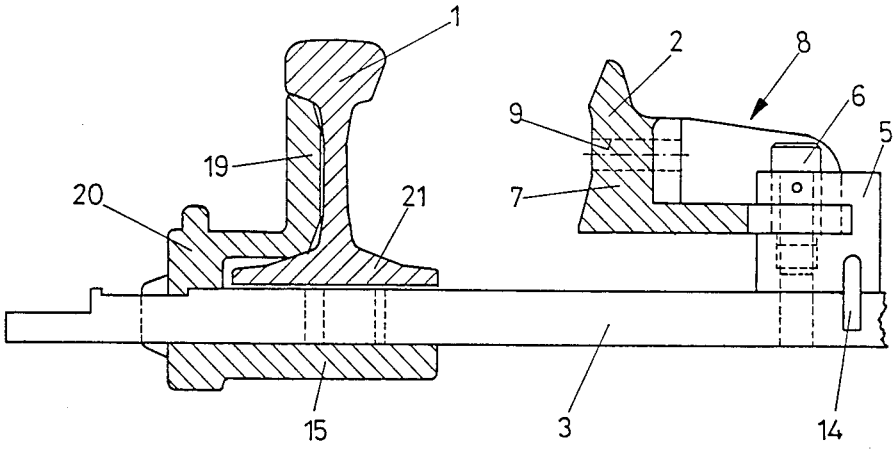
FIGS. 1 and 2 respectively show a cross-section through the stock rail and the tongue rail and a top plan view thereof in the open position.
Figure 2:
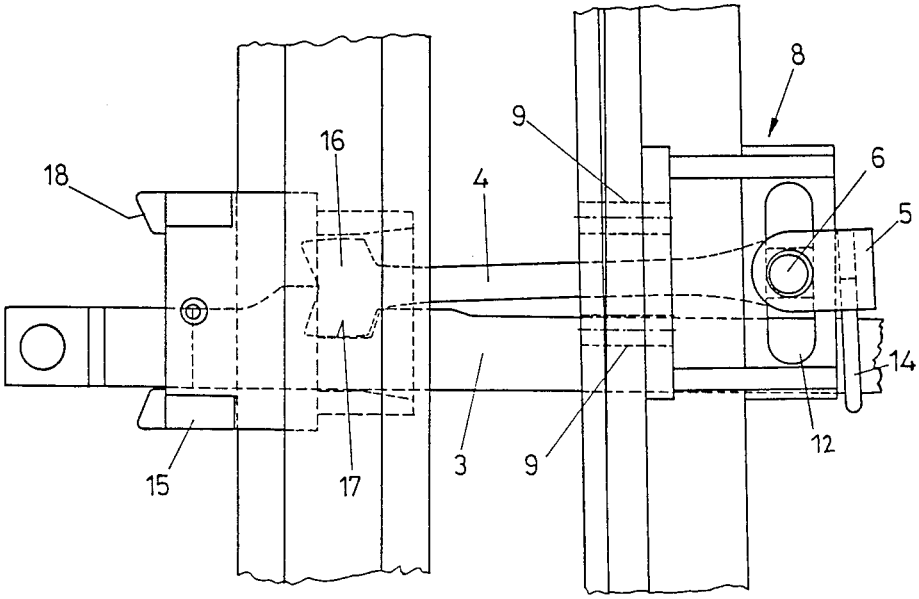

In the embodiment according to FIGS. 1 and 2, reference numeral 1 represents the stock rail and reference numeral 2 represents the tongue rail. Reference numeral 3 represents the push rod and reference numeral 4 represents the locking clamp, the swivel head 5 of which is swivelably connected with a pin 6 of the tongue rail 2.

Figure 5:
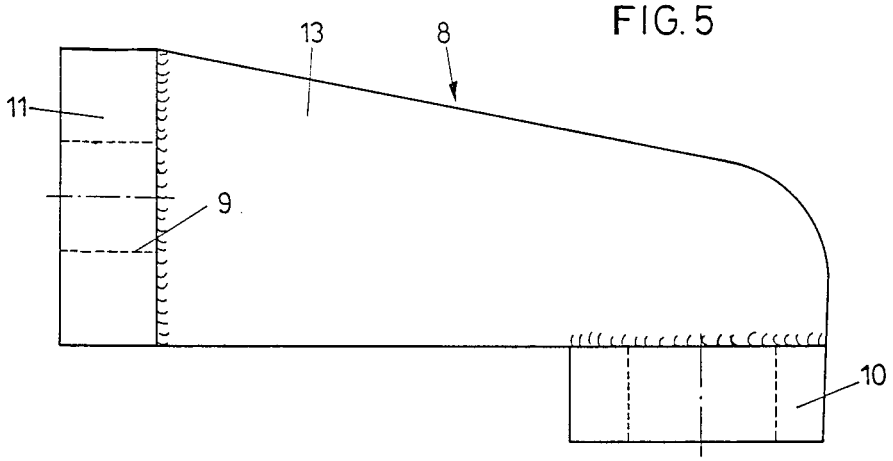
FIGS. 5 and 6 respectively show the connecting member in a side elevation and in a top plan view.
Figure 6:
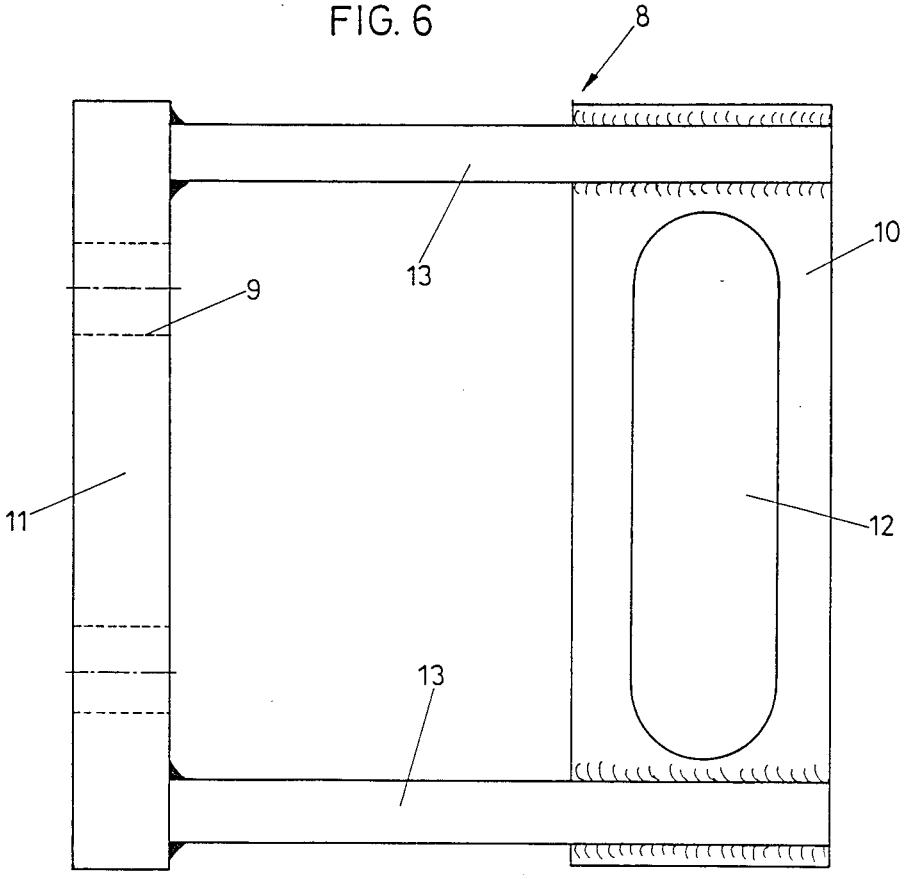

A connecting member 8 is threadedly connected to the web 7 of the tongue rail, the threaded holes being designated by the reference numeral 9. The connecting member 8, which is shown at a greater scale in FIGS. 5 and 6, comprises two plates 10 and 11 having parallel sides, noting that the plate 10 is provided with an elongated slot 12 which is engaged by the pin 6. The plates 10 and 11 are connected one with the other by lateral cheeks 13 welded to said plates. The swivel head 5 has a bracket 14 which embraces the push rod 3 like a hook and thus connects the swivel head 5 with the push rod. The locking clamp 4 is thus shiftably connected with the push rod 3.

Reference numeral 15 represents the locking piece, within which is guided the push rod 3 and the locking clamp 4. In the open position, the locking clamp head 16 of the locking clamp 4 is located within a recess 17 of the push rod 3. In the locked position (FIGS. 3 and 4), the locking clamp head 16 contacts the entry opening 18 of the locking piece 15, so that the tongue rail 2 is maintained in a position contacting the stock rail. The locking piece 15 is combined with a flange 19 to an integral component part 20 embracing the rail foot 21 of the stock rail, said flange 19 being threadedly connected to the outer side of the stock rail 1.

Figure 3:
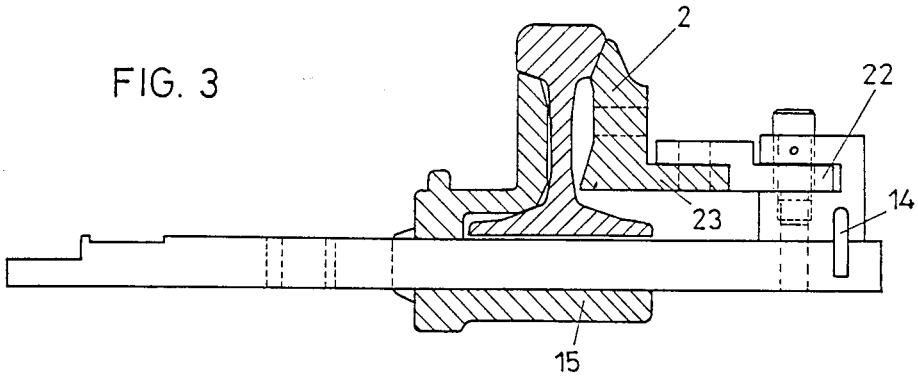
FIGS. 3 and 4 respectively show a cross-section through the stock rail and the tongue rail and a top plan view thereof in the closed condition for a somewhat modified embodiment.
Figure 4:
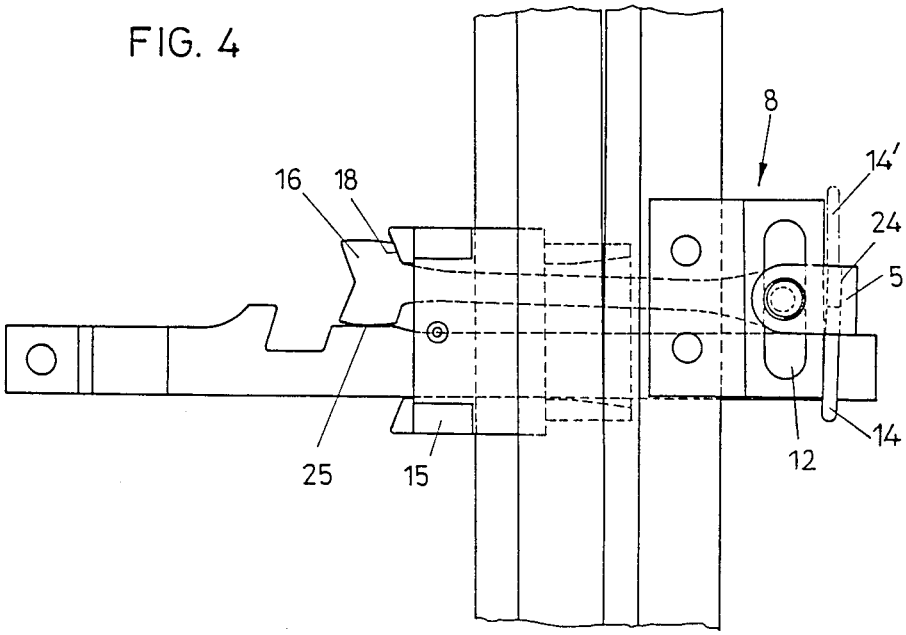

The closed position of the tongue rail 2 is shown in the FIGS. 3 and 4. The embodiment according to FIGS. 3 and 4 differs from the embodiment according to FIGS. 1 and 2 only inasfar as the connecting member 22 is threadedly connected to the rail foot 23 of the tongue rail. This connecting member 22 consists of a cropped flap extending within the plane of the rail foot 23.

In FIGS. 1 to 4, the bracket 14 is arranged at one side of the swivel head 5. This bracket 14 is inserted into a hole 24 of the swivel head 5 and welded with the swivel head 5. The bracket may also be arranged at both sides as is indicated in FIG. 4 by the reference numeral 14', so that the same locking clamp 4 may be used for right-hand locking and left-hand locking.

The flanks 25 of the locking clamp head 16 are slightly vaulted or, respectively, arcuately shaped for reducing the friction within the locking piece 15.

Figure 7:
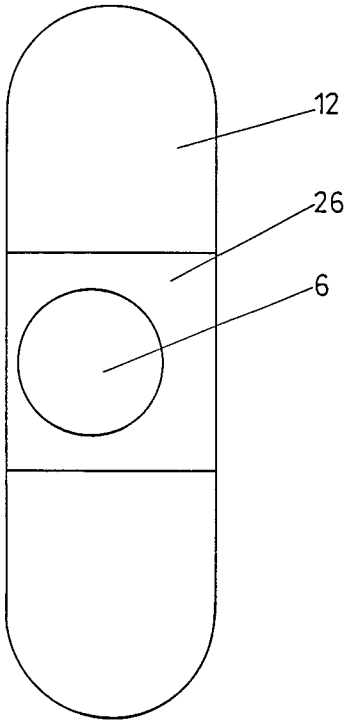
FIGS. 7 shows a sliding block.

The pin 6 is guided within the elongated slot 12 with interposition of a sliding block 26. As is shown in FIG. 7, the pin 6 is eccentrically positioned within a sliding block 26 of square shape. By rotating the sliding block, the distance of the pin 6 from the tongue rail may be adjusted.

The connecting member can also be made of cast iron or forging steel.

What is claimed is:

1. A switch control mechanism, comprising:

a locking piece including means for fixing the locking piece in relation to a stock rail;

a connecting member including means for fixing the connecting member to a laterally shiftably supported switch tongue rail which is laterally shiftable between an open position in which it is spaced laterally from the stock rail, and a closed position in which it is engaged side by side with the stock rail;

means defining a longitudinally elongated slot in said connecting member;

a pivot pin;

means mounting said pivot pin in said slot for limited movement longitudinally of said switch control mechanism;

a laterally extending locking clamp having a swivel head provided thereon at one end thereof;

said swivel head being mounted to said connecting member by said pivot pin, whereby said connecting member is constrained to move laterally with said locking lamp, but said one end of said locking clamp can move longitudinally of said switch control mechanism to a limited extent as said pivot pin moves longitudinally of said switch control mechanism in said slot;

said locking clamp including at an opposite end thereof an enlarged locking clamp head;

said locking piece including a laterally oriented entry opening therethrough having associated with an end facing away from said connecting member a locking shoulder;

a laterally elongated push rod;

means mounting said push rod in relation to said swivel head of said locking clamp such as to permit said push rod to be reciprocated laterally of said switch control mechanism;

said push rod having a flank surface facing longitudinally of said switch control mechanism and towards a flank surface of said locking clamp;

means defining a recess in said flank surface of said push rod, for reversibly receiving a first portion of said enlarged locking clamp head;

said locking clamp and said push rod extending through said entry opening of said locking piece;

caming surface means provided on said flank surface of push rod adjacent said recess, for cooperating with said flank surface of said locking clamp; and a second portion of said enlarged locking clamp head being arranged to engage said locking shoulder of said locking piece upon caming of said locking head longitudinally of said switch control mechanism by engagement of said first portion of said enlarged locking clamp head by said caming surface means of said flank surface of said push rod, whereby, as said push rod is reciprocated laterally of the switch control mechanism to provide a switch-open position from a switch-closed position said second portion of said locking clamp enlarged head slides into said recess, freeing said first portion of said locking clamp enlarged head from locking engagement with said shoulder of said locking piece, whereupon said locking clamp reciprocates laterally of the switch control mechanism as a unit with the push rod, thus moving the pivot pin and connecting member laterally of the switch control mechanism, away from the locking piece, and, as said push rod is reciprocated laterally of the switch control mechanism to provide a switch-closed position from a switch-open position, said locking clamp initially reciprocates laterally of the switch control mechanism as a unit with the push rod, thus moving the pivot pin and connecting member laterally of the switch control mechanism, towards the locking piece, and, as the switch tongue rail engages the stock rail side-by-side, and the push rod continues to be moved laterally of the switch control mechanism, said second portion of said locking clamp enlarged head is pushed out of said recess and camed longitudinally of the switch control mechanism, causing the first portion of the locking clamp enlarged head to engage said shoulder of said locking piece.

2. The switch control mechanism of claim 1, wherein:

said connecting member comprises a horizontal plate having an upper and a lower surface which are parallel to one another;

said slot being provided through said plate so as to open through said upper and lower surface; and said swivel head embraces said plate from above and below.

3. The switch control mechanism of claim 1, wherein:

said means mounting said push rod in relation to said swivel head comprises a bracket mounted to said swivel head.

4. The switch control mechanism of claim 3, wherein:

said bracket is a hook-shaped member welded to said swivel head.

5. The switch control mechanism of claim 1, wherein:

said means mounting said pivot pin in said slot is a sliding block which is square in transverse cross-section so as to be mountable in said slot in any selected one of four positions by removal, rotation of said block relative to said slot and reinstallation;

said pivot pin being disposed off-center on said sliding block in two directions, whereby mounting of said sliding block in each of said four positions disposes said pin at four different locations for any given disposition of said sliding block along said slot.

6. The switch control mechanism of claim 2, wherein:

said connecting member further includes vertical plate; two longitudinally spaced laterally extending cheeks securing said vertical plate to said horizontal plate; and said means for fixing said connecting member to a laterally shiftably supported switch tongue rail comprises means for securing the vertical plate to a web of the switch tongue rail.

7. The switch control mechanism of claim 2, wherein:

said connecting member includes an upwardly-stepped horizontal flap of said horizontal plate; and said means for fixing said connecting member to a laterally shiftably supported switch tongue rail comprises means for securing said flap onto a foot of the switch tongue rail.

* * * * *